US012044440B2

(12) United States Patent
Teranishi

(10) Patent No.: US 12,044,440 B2
(45) Date of Patent: Jul. 23, 2024

(54) PIPING COVER

(71) Applicant: RINNAI CORPORATION, Aichi (JP)

(72) Inventor: Shogo Teranishi, Aichi (JP)

(73) Assignee: RINNAI CORPORATION, Aichi (JP)

( * ) Notice: Subject to any disclaimer, the term of this patent is extended or adjusted under 35 U.S.C. 154(b) by 232 days.

(21) Appl. No.: 17/733,352

(22) Filed: Apr. 29, 2022

(65) Prior Publication Data

US 2022/0381479 A1 Dec. 1, 2022

(30) Foreign Application Priority Data

May 26, 2021 (JP) ..... 2021-088411

(51) Int. Cl.
*F24H 9/02* (2006.01)

(52) U.S. Cl.
CPC ..... *F24H 9/02* (2013.01)

(58) Field of Classification Search
CPC .... F24H 9/02; F16B 5/10; F16B 12/34; F16B 21/09; F16B 37/0842; F16B 12/22; F16B 21/02; F16B 5/0621; F16B 5/065; F16B 5/0664; F24F 1/56; F24F 1/16; F24F 13/20; F24F 1/22; H05K 5/03; A47B 47/02; A47B 47/042; A47B 57/50; A47B 47/00; A47B 2230/07; A47B 87/0276; D06F 39/125; D06F 29/005
USPC ..... 312/236
See application file for complete search history.

(56) References Cited

U.S. PATENT DOCUMENTS 3,596,942 A * 8/1971 Zoebelein ..... F16B 12/22 211/186
4,042,201 A * 8/1977 O'Callaghan ..... B60R 11/0205 292/87
4,129,743 A * 12/1978 Lohsl ..... H02G 15/076 220/366.1
4,788,395 A * 11/1988 Sakoda ..... H05B 6/6426 29/513
5,241,860 A * 9/1993 Po ..... G01D 11/24 73/431
5,957,557 A * 9/1999 Langer ..... F24C 15/08 312/236
7,708,008 B2 * 5/2010 Elkasevic ..... F24C 15/006 219/394
8,672,426 B2 * 3/2014 Heo ..... D06F 29/00 312/111
9,066,416 B2 * 6/2015 Lee ..... H05K 5/0013
11,330,920 B1 * 5/2022 Rogers ..... A47B 95/04
(Continued)

FOREIGN PATENT DOCUMENTS

JP 2014-105910 6/2014

*Primary Examiner* — Hiwot E Tefera
(74) *Attorney, Agent, or Firm* — Wenderoth, Lind & Ponack, L.L.P.

(57) ABSTRACT

A piping cover (6) has a side plate (8), wherein the side plate (8) includes a connecting flange (81) extending toward an inside of the piping cover (6) at an upper end thereof, the connecting flange (81) has an L-shaped notch (85) into which a connector (5) protruding downward from a bottom surface (23) of the casing (1) is inserted, and the L-shaped notch (85) includes a first slit (85*a*) opening to an inner end of the connecting flange (81) and extending outward from the inner end of the connecting flange (81), and a second slit (85*b*) bent and extending from an outer end of the first slit (85*a*).

2 Claims, 6 Drawing Sheets

(56) References Cited

U.S. PATENT DOCUMENTS

| | | | | |
|---|---|---|---|---|
| 2008/0185942 | A1* | 8/2008 | Elkasevic | F24C 15/006 312/236 |
| 2010/0264787 | A1* | 10/2010 | Fan | G06F 1/184 312/223.2 |
| 2014/0224795 | A1* | 8/2014 | Parnall | B65D 19/38 220/7 |
| 2018/0055219 | A1* | 3/2018 | Lim | F16B 12/30 |
| 2021/0017692 | A1* | 1/2021 | James | D06F 39/125 |

* cited by examiner

PIPING COVER

FIELD OF THE INVENTION

The present invention relates to a piping cover disposed below a casing accommodating a heat source device and detachably connected to the casing.

DESCRIPTION OF THE RELATED ART

A piping cover for covering a pipe extending downward from a heat source device such as a water heater may be disposed below a casing that accommodates the heat source device. The piping cover is detachably connected to the casing by using a connector such as a fixing screw at an installation site of the heat source device. Hence, for example, from a view point of workability of installation, there has been proposed a cover fixing structure in which an engagement protrusion protruding downward is provided on a bottom surface of a casing, a figure 8-shaped hole (snowman shaped hole) including a large hole part and a small hole part having different diameters is drilled in a flange of an upper end of a side plate of a piping cover, and an elastic support part protruding downward is provided on a wall part in a vicinity of the figure 8-shaped hole of the flange (For example, a Japanese Unexamined Patent Publication No. JP 2014-105910 A). According to the conventional piping cover, a large-diameter head part of the engagement protrusion attached to the bottom surface of the casing is inserted into the large hole part, and then a small-diameter shaft part of the engagement protrusion is slid into the small hole part. As a result, the engagement protrusion is engaged with a peripheral edge of the small hole part against the elasticity of the elastic support part, and the piping cover is connected to the casing. Accordingly, the piping cover can be connected to the casing without detaching the engagement protrusion from the bottom surface of the casing.

In a case where the figure 8-shaped hole as the conventional piping cover is drilled in a metal plate, a certain width is required for the flange in order to secure strength. However, a space for disposing the pipe needs to be secured below the casing. Hence, a width of the flange extending inward from the upper end of the side plate of the piping cover is limited to a certain extent. As a result, only a large hole part having a diameter sufficiently smaller than the width of the flange can be formed, and there may be cases where the figure 8-shaped hole cannot be formed. Further, the figure 8-shaped hole has the large hole part and the small hole part. Hence, in a case where the figure 8-shaped hole is drilled in the flange, the engagement protrusion cannot be inserted into the large hole part unless the head part of the engagement protrusion is aligned with the large hole part. For this reason, there is a problem that the engagement protrusion provided on the bottom surface of the casing collides with the flange in the vicinity of the figure 8-shaped hole, causing deformation or damage in the flange.

SUMMARY OF THE INVENTION

The present invention has been made to solve the problem described above, and an object of the present invention is to provide a piping cover excellent in workability.

According to the present invention, there is provided a piping cover disposed below a casing accommodating a heat source device and detachably connected to the casing, the piping cover comprising a side plate, wherein the side plate includes a connecting flange extending toward an inside of the piping cover at an upper end thereof, the connecting flange has an L-shaped notch into which a connector protruding downward from a bottom surface of the casing is inserted, and the L-shaped notch includes a first slit opening to an inner end of the connecting flange and extending outward from the inner end of the connecting flange, and a second slit bent and extending from an outer end of the first slit.

According to the present invention, the piping cover excellent in workability can be provided.

Other objects, features and advantages of the present invention will become more fully understood from the detailed description given hereinbelow and the accompanying drawings which are given by way of illustration only, and thus are not to be considered as limiting the present invention.

DETAILED DESCRIPTION OF THE EMBODIMENTS

Hereinafter, a piping cover according to an embodiment of the present invention will be specifically described by taking, as an example, a piping cover connected to a casing that accommodates a gas water heater as a heat source device.

Figure 1:
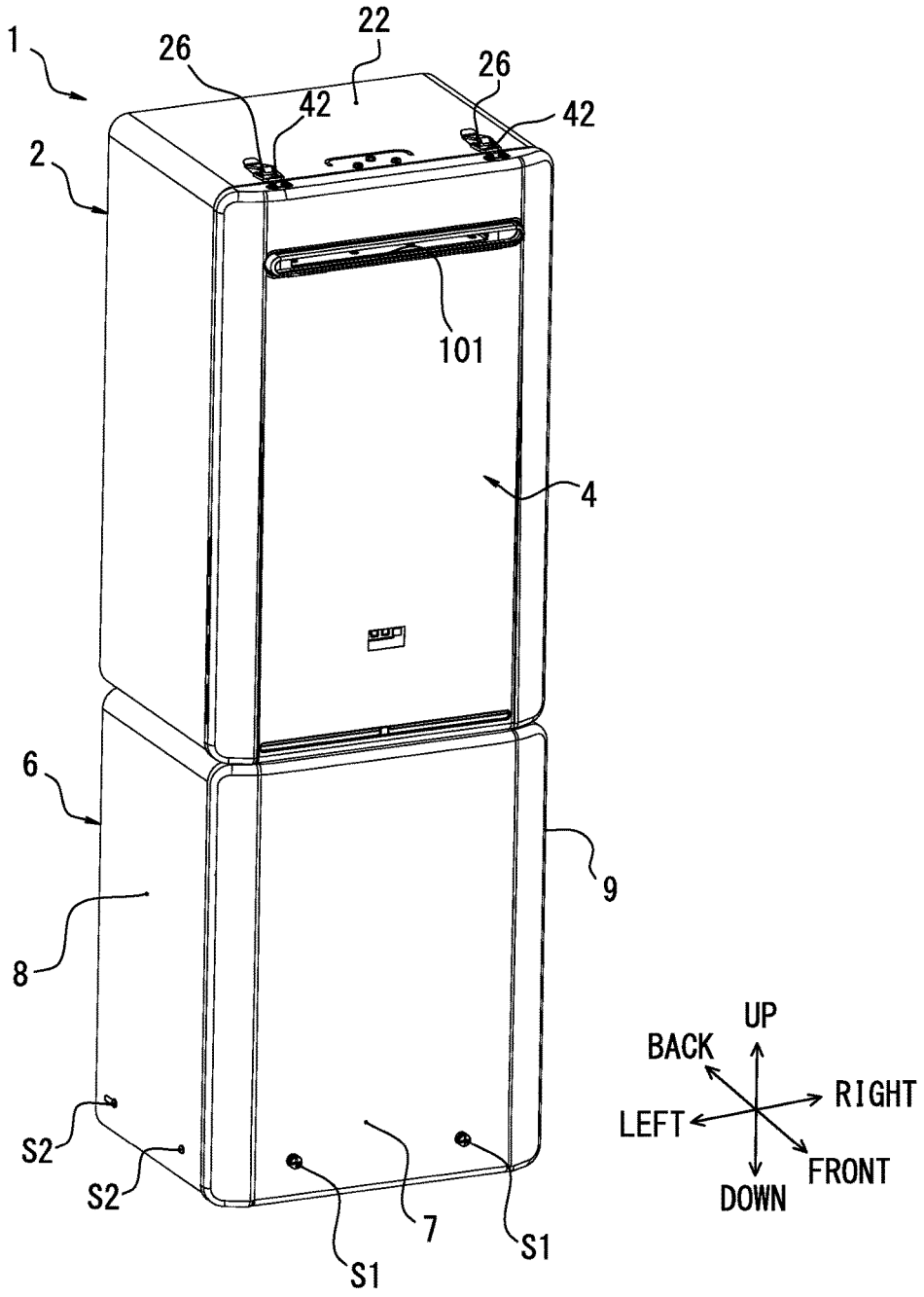
FIG. 1 is a schematic perspective view showing a state in which a casing and a piping cover are connected to each other according to an embodiment of the present invention.
Figure 2:
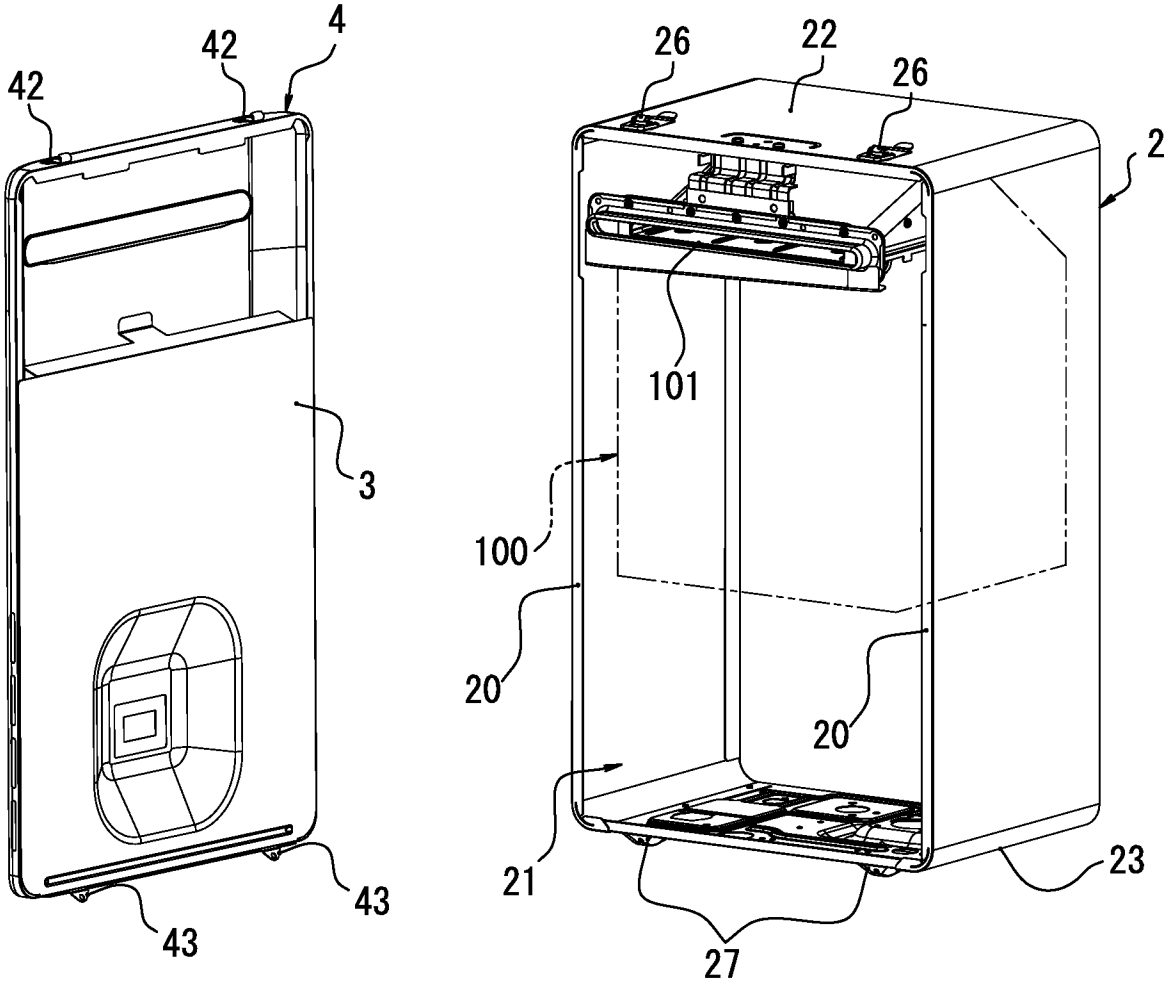
FIG. 2 is a schematic partial exploded perspective view showing the casing according to the embodiment of the present invention.

As illustrated in FIG. 1, a piping cover 6 is disposed below a casing 1 that accommodates a gas water heater 100 (see FIG. 2). An electric water heater, an oil-fired water heater, or the like may be used as the heat source device.

Although not illustrated, the water heater 100 including a gas burner and a heat exchanger is accommodated in the casing 1. As illustrated in FIGS. 1 and 2, the casing 1 includes a casing body 2 whose front side is opened, a decorative cover (front cover) 4 forming a front surface of the casing 1, and a lid body 3 fixed to a rear surface of the decorative cover 4. Each of the casing body 2, the lid body 3, and the decorative cover 4 is formed by molding a sheet metal into a predetermined shape. In the present specification, a decorative cover 4 side of the casing 1 is referred to as a front side, a depth direction of the casing 1 is referred to as a longitudinal direction, a width direction of the casing 1 is referred to as a lateral direction, and a height direction of the casing 1 is referred to as a vertical direction.

The casing body 2 has a substantially rectangular box shape. On an inner peripheral edge of a front opening 21 of the casing body 2, an inner flange 20 bent and extending inward at upper, lower, left, and right ends is formed by folding ends of a top surface 22, a bottom surface 23, and left and right side surfaces of the casing body 2 to an inner side of the front opening 21. In a vicinity of the front end of an outer surface of the top surface 22 of the casing body 2, a plurality of (two in this embodiment) buckle fasteners 26 separated to left and right ends are provided. In a vicinity of the front end of an outer surface of the bottom surface 23 of the casing body 2, substantially square frustum-shaped base parts 27 (see FIGS. 3 and 5) separated to the left and right ends and bulging downward are formed. Although not illustrated, a screw hole is formed in one surface on the front side of the base part 27.

Figure 3:
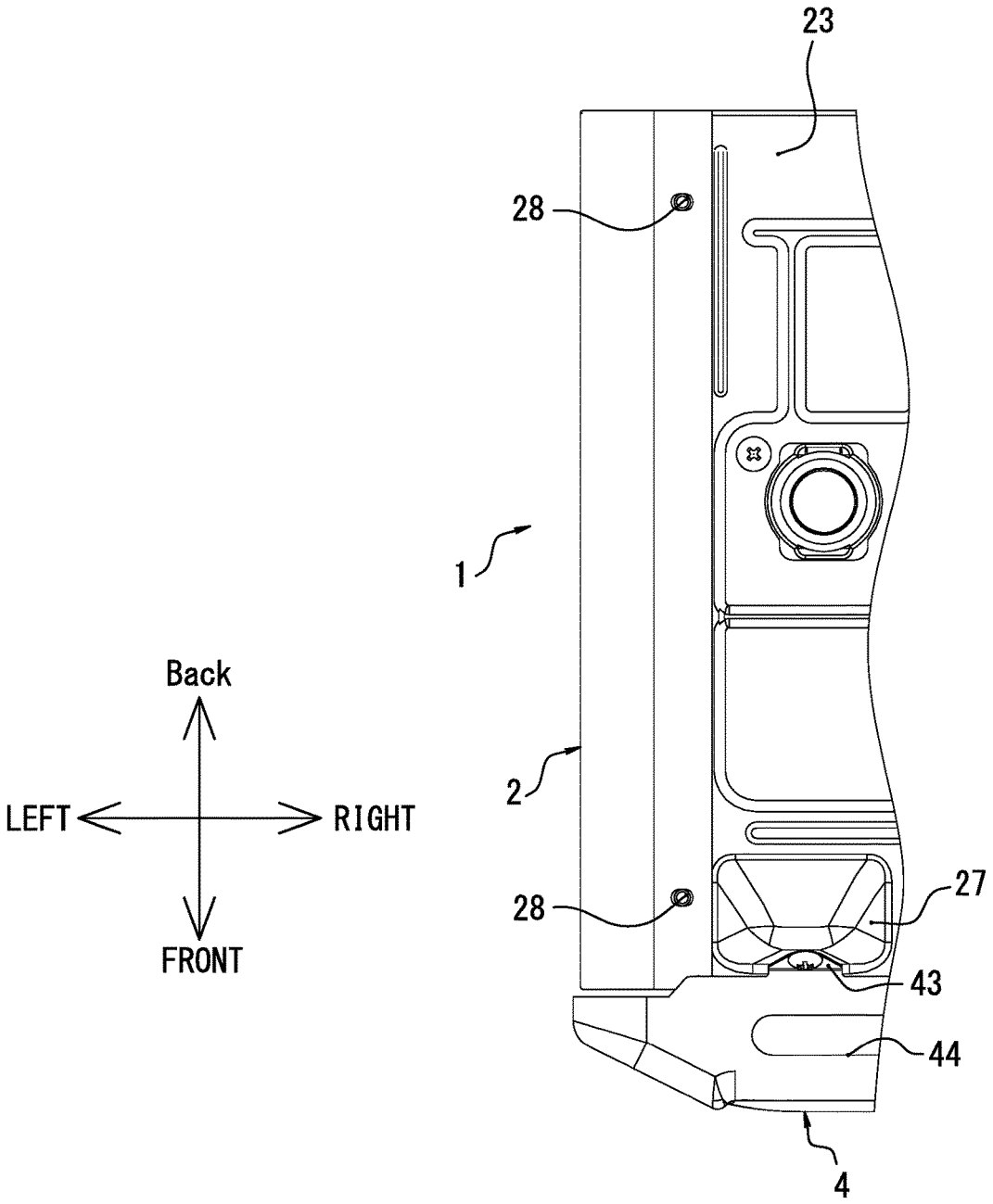
FIG. 3 is a schematic partial plan view showing a left end of a bottom surface of the casing according to the embodiment of the present invention.

As illustrated in FIG. 3, in a vicinity of a left end of the bottom surface 23 of the casing body 2, a plurality of (two in this embodiment) screw holes 28 separated to front and rear ends are formed. Although not illustrated, likewise, in a vicinity of a right end of the bottom surface 23 of the casing body 2, a plurality (two in this embodiment) of screw holes 28 separated to front and rear ends are formed. Fixing screws 5 as left and right connectors are screwed into these screw holes 28 (see FIGS. 5 and 6). The fixing screw 5 has a head part 5*a* having a large-outer diameter and a screw shaft part 5*b* having a small-outer diameter smaller than that of the head part 5*a*. A butterfly bolt, a hexagonal bolt, or the like may be used as the connector.

Returning to FIG. 2, the lid body 3 is formed in a flat plate shape. A width of the lid body 3 in the lateral direction is set to be substantially the same as that of the inner flange 20 of the casing body 2. Accordingly, the lid body 3 is formed such that an outer peripheral edge of the lid body 3 comes into contact with the inner flange 20 of the casing body 2. A vertical height of the lid body 3 is set lower than that of the front opening 21 of the casing body 2. Note that it is not necessarily required to use the lid body 3.

The decorative cover 4 has a substantially rectangular shallow pan-like shape whose rear side is opened. Hence, the decorative cover 4 has a front plate and an outer peripheral side plate bent and extending backward from a peripheral edge of the front plate. The decorative cover 4 is formed such that an outer surface of the outer peripheral side plate is substantially flush with a peripheral surface of the casing body 2 when the decorative cover 4 is attached to the casing body 2. Accordingly, the casing 1 has an excellent appearance. An exhaust cylinder 101 of the gas water heater 100 protrudes frontward from an exhaust cylinder insertion port provided in the decorative cover 4.

Arm locking parts 42 to which arms of the buckle fastener 26 are locked are provided in a vicinity of a rear end of the outer surface of an upper portion of the outer peripheral side plate of the decorative cover 4 at positions corresponding to the buckle fasteners 26 provided on the top surface 22 of the casing body 2 described above. Additionally, left and right tongue pieces 43 extending obliquely backward and downward from a rear end of the outer peripheral side plate are formed on a lower portion of the outer peripheral side plate of the decorative cover 4 at positions corresponding to the base parts 27 described above. A screw insertion hole is formed in each tongue piece 43. Accordingly, the arm of the buckle fastener 26 on the top surface 22 of the casing body 2 is engaged with the arm locking part 42 of the decorative cover 4, and a mounting screw is screwed into the screw hole of the base part 27 through the screw insertion hole of the tongue piece 43 from the front side of the decorative cover 4, whereby the casing body 2 and the decorative cover 4 are connected to each other in a detachable manner.

As illustrated in FIG. 3, an upper ventilation part including a plurality of upper ventilation holes 44 is formed in the lower part of the outer peripheral side plate of the decorative cover 4. As illustrated in FIG. 1, in a state where the decorative cover 4 is attached to the casing body 2, a length in the longitudinal direction and a width in the lateral direction of the piping cover 6 are set to be substantially the same as those of the casing 1. Hence, the casing 1 and the piping cover 6 are designed to be continuous and unified upper and lower parts. Although not illustrated, pipes such as a water supply pipe and a hot-water supply pipe extending downward from the gas water heater 100 are housed in the piping cover 6.

Figure 4:
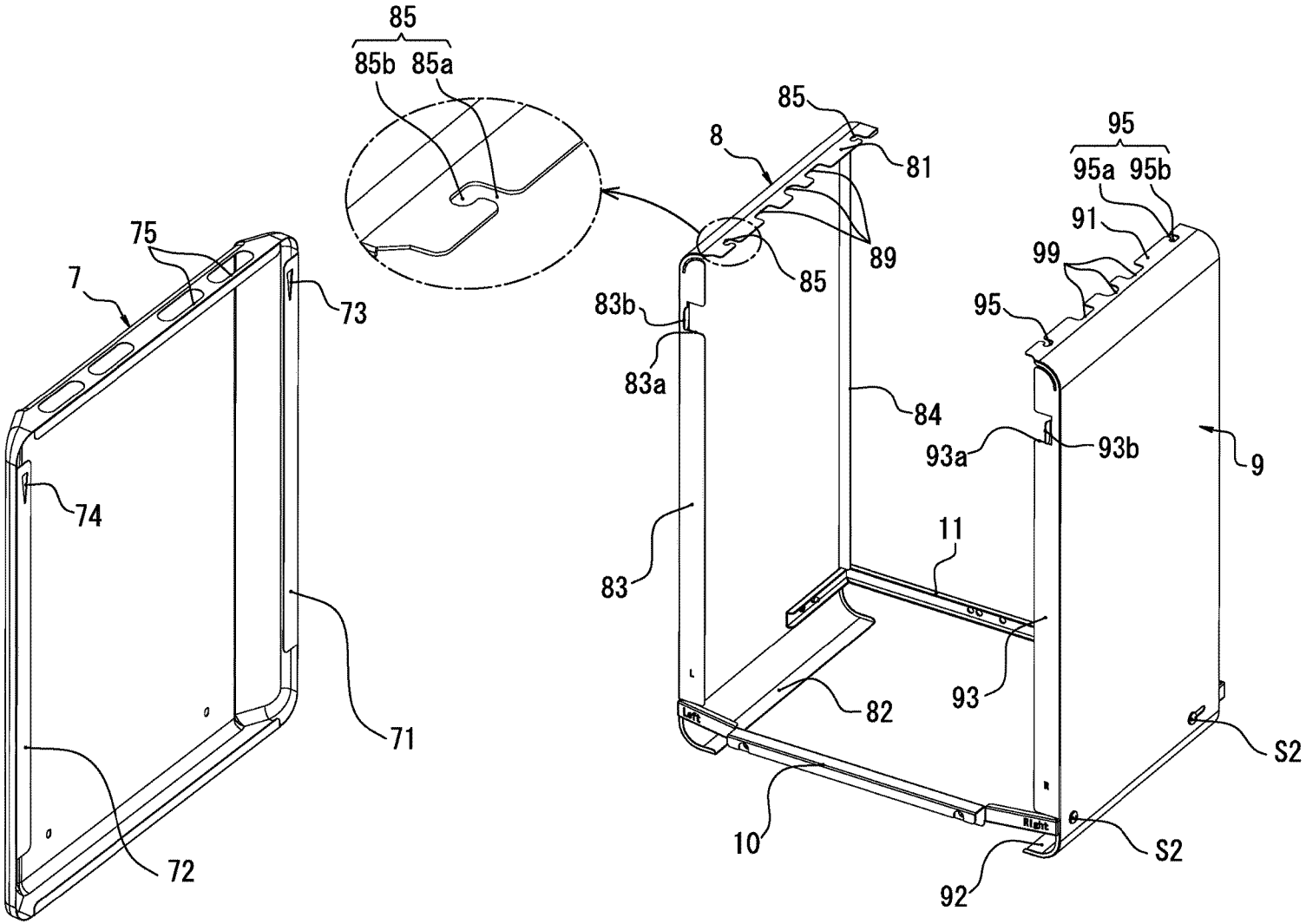
FIG. 4 is a schematic partial exploded perspective view showing the piping cover according to the embodiment of the present invention.

As illustrated in FIG. 4, the piping cover 6 has rear, upper, and bottom openings. As viewed from the front side, the piping cover 6 includes a front side plate 7, a left side plate 8, and a right side plate 9 that support the casing 1 from below. The piping cover 6 has a substantially U-shape in a plan view. Each of these side plates 7,8,9 is formed by molding a sheet metal into a predetermined shape. These side plates 7, 8, 9 are connected to each other in a detachable manner. The piping cover 6 may have a rear side plate and a lower side plate.

The front side plate 7 and the left and right side plates 8, 9 are connected by a front fixing frame 10 provided on an inner front side of the piping cover 6. The left and right side plates 8, 9 are connected by a rear fixing frame 11 provided on an inner rear side of the piping cover 6. The front fixing frame 10 has a substantially U-shape in a plan view. The front fixing frame 10 includes left and right fixing parts (not illustrated) fixed to lower inner surfaces of the left and right side plates 8, 9, and a front fixing part fixed to a lower rear surface of the front side plate 7. The rear fixing frame 11 has a substantially U-shape in a plan view. The rear fixing frame 11 includes left and right fixing parts fixed to lower inner surfaces of the left and right side plates 8, 9. Each of the side plates 7, 8, 9 has a plurality of screw insertion holes drilled at predetermined positions. The front and rear fixing frames 10, 11 are fixed to the side plates 7, 8, 9 by decorative screws S1 and small screws S2 inserted from an outside through the screw insertion holes in the side plates 7, 8, 9. Accordingly, only a small number of decorative screws S1 are exposed on a front surface of the piping cover 6, and the piping cover 6 has an excellent appearance.

The front side plate 7 has a substantially rectangular shallow pan-like shape whose rear side is opened. The front side plate 7 includes a left rear flange 71 that is bent inward at a rear end of a left outer peripheral side plate corresponding to a left end of the front side plate 7 and extends inward from the rear end of the left outer peripheral side plate, and a right rear flange 72 that is bent inward at a rear end of a right outer peripheral side plate corresponding to a right end of the front side plate 7 and extends inward from the rear end of the right outer peripheral side plate. Each of the left and right rear flanges 71, 72 is a vertically long strip member. Substantially triangular left and right engagement holes 73, 74 are drilled in vicinities of upper ends of the left and right rear flanges 71, 72, respectively. A lower ventilation part including a plurality of lower ventilation holes 75 is formed in an upper portion of the outer peripheral side plate of the front side plate 7. Each of these lower ventilation holes 75 is formed so as to face the upper ventilation hole 44 of the decorative cover 4 in the vertical direction when the piping cover 6 is connected to the casing 1. As a result, when the gas water heater 100 is in operation, an air flow path is formed in the vertical direction, and the decorative cover 4 is cooled.

The left and right side plates 8, 9 are each formed in a substantially rectangular shape in a plan view. The left and right side plates 8, 9 have the same configuration except that the left and right side plates 8, 9 are formed symmetrically. Hence, in the following description, the configuration of the left side plate 8 will be mainly described, and the configuration of the right side plate 9 that is the same as or similar to the configuration of the left side plate 8 will be denoted by similar reference numerals, and the description thereof will be omitted.

Figure 5:
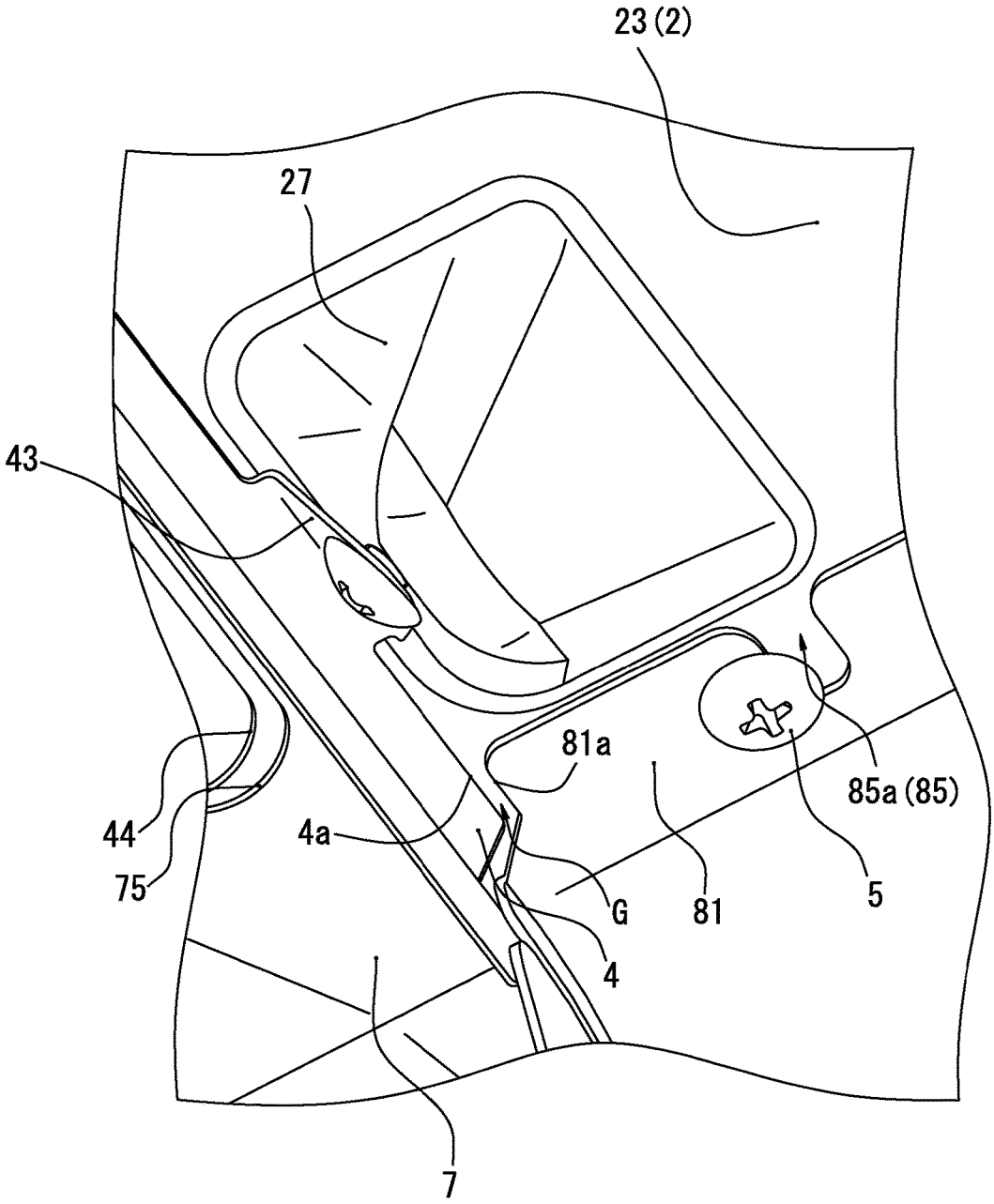
FIG. 5 is a schematic partial perspective view showing, from below, the state in which the casing and the piping cover are connected to each other according to the embodiment of the present invention.
Figure 6:
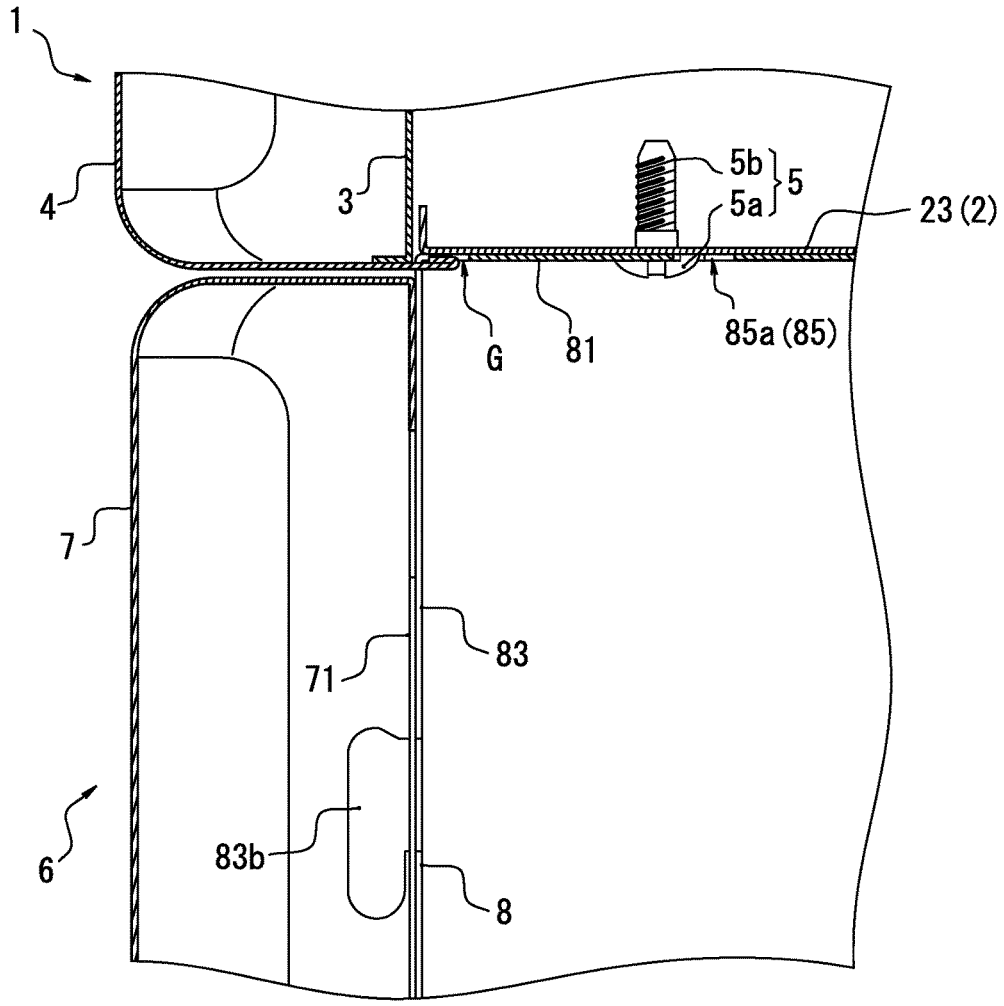
FIG. 6 is a schematic partial vertical cross-sectional view showing the state in which the casing and the piping cover are connected to each other according to the embodiment of the present invention.

As illustrated in FIGS. 4 to 6, the left side plate 8 includes a left connecting flange 81 that is bent inward at an upper end thereof and extends substantially horizontally in the lateral direction, a lower left flange 82 that is bent inward at a lower end thereof and extends substantially horizontally in the lateral direction, a left front flange 83 that is bent inward at a front end thereof and extends in the lateral direction, and a left rear flange 84 that is bent inward at a rear end thereof and extends in the lateral direction. Each of the left connecting flange 81 and the lower left flange 82 is a longitudinally long strip member. Each of the left front flange 83 and the left rear flange 84 is a vertically long strip member. The left connecting flange 81 is formed such that when the piping cover 6 is connected to the casing 1, a front end edge 81*a* of the left connecting flange 81 and a rear end edge 4*a* of the lower portion of the outer peripheral side plate of the decorative cover 4 forming a rear end edge of a lower end of the front cover face each other with a gap G (e.g., about 0.5 mm) of a certain size interposed therebetween. Further, the left front flange 83 is formed such that when the front side plate 7 is connected to the left side plate 8, a front surface of the left front flange 83 of the left side plate 8 substantially comes into contact with a rear surface of the left rear flange 71 of the front side plate 7.

The left connecting flange 81 has a plurality of (two in this embodiment) left L-shaped notches 85 and a plurality of (three in this embodiment) left horizontal U-shaped notches 89 formed by punching or the like. The two left L-shaped notches 85 are separated to front and rear ends of the left connecting flange 81. The three left horizontal U-shaped notches 89 are formed at predetermined intervals between the front and rear left L-shaped notches 85. An element member of the gas water heater 100 protruding downward from the bottom surface 23 of the casing body 2 is inserted into the left horizontal U-shaped notch 89. In this embodiment, the left L-shaped notch 85 and the left horizontal U-shape notch 89 of the left connecting flange 81 are opposed to a right L-shaped notch 95 and a right horizontal U-shaped notch 99 of the right connecting flange 91, respectively. However, those members may be formed at positions different from each other, in accordance with a configuration of the heat source device.

The left L-shaped notch 85 has a left first slit 85*a* and a left second slit 85*b* communicating with the left first slit 85*a*. The left first slit 85*a* opens to an inner end of the left connecting flange 81 and extends laterally leftward from the inner end of the left connecting flange 81 to a center in the lateral direction of the left connecting flange 81 so as to be substantially orthogonal to the left connecting flange 81 extending in the longitudinal direction. The left second slit 85*b* is bent at a substantially right angle at an outer end of the left first slit 85*a* and extends frontward from the outer end of the left first slit 85*a* in the left connecting flange 81. The left first slit 85*a* may obliquely extend leftward from the inner end of the left connecting flange 81. Additionally, the left second slit 85*b* may be bent at an acute angle or an obtuse angle at the outer end of the left first slit 85*a* and extend in the longitudinal direction from the outer end of the left first slit 85*a* in the left connecting flange 81. The left second slit 85*b* may be bent backward at the outer end of the left first slit 85*a* and extend backward from the outer end of the left first slit 85*a* in the left connecting flange 81. In other word, the left second slit 85*b* may be bent at the outer end of the left first slit 85*a* and extend in any one of the longitudinal directions from the outer end of the left first slit 85*a*.

The left L-shaped notch 85 is formed such that when the piping cover 6 is connected to the casing 1, the left second slit 85*b* faces the screw hole 28 provided in the vicinity of the left end of the bottom surface 23 of the casing body 2 in the vertical direction. Slit widths of the left first slit 85*a* and the left second slit 85*b* are formed to be smaller than the outer diameter of the head part 5*a* of the fixing screw 5 and larger than the outer diameter of the screw shaft part 5*b* of the fixing screw 5 described above. Note that lengths and widths of the left first slit 85*a* and the left second slit 85*b* may be the same or different.

The left front flange 83 has, in a vicinity of an upper end, a horizontal U-shaped left connecting notch 83*a* cut out laterally from an inner end thereof. A left locking piece 83*b* cut and raised frontward from an outer end of the left connecting notch 83*a* is formed on an outer vertical side of the left connecting notch 83*a*. The left locking piece 83*b* is formed at a position corresponding to the left engagement hole 73 of the left rear flange 71 of the front side plate 7 described above. Accordingly, in the piping cover 6 of the present embodiment, the front side plate 7 and the left and right side plates 8, 9 are connected by engaging the left and right locking pieces 83*b*, 93*b* with the left and right engagement holes 73, 74 in an upper region, and fixing the front and rear fixing frames 10, 11 to these side plates 7, 8, 9 in a lower region. With this configuration, the piping cover 6 has high strength.

Next, an example of a connecting procedure for connecting the casing 1 and the piping cover 6 will be described.

First, the fixing screw 5 is screwed into the screw hole 28 to a position before the fixing screw 5 is fastened to a final fastening position, so that the fixing screw 5 protrudes downward from the bottom surface 23 of the casing body 2 by a certain height. Next, the screw shaft part 5*b* of the fixing screw 5 is inserted into the left first slit 85*a* from the inner end of the left connecting flange 81 of the left side plate 8, and is further slid to a final end (i.e., in a vicinity of a front end) of the left second slit 85*b*. Then, the fixing screw 5 is screwed to the final fastening position to fix the left side plate 8 to the casing 1. Similarly, the right side plate 9 is fixed to the casing 1. In a state where the left and right side plates 8, 9 are fixed to the casing 1 as described above, the left and right locking pieces 83*b*, 93*b* formed in the left and right front flanges 83, 93 of the left and right side plates 8, 9 are engaged with the left and right engagement holes 73, 74 formed in the left and right rear flanges 71, 72 of the front side plate 7, and the front side plate 7 and the left and right side plates 8, 9 are temporarily fixed. Then, the front and rear fixing frames 10, 11 are fixed to the front side plate 7 and the left and right side plates 8, 9 by the screws S1, S2. As described above, the front surface of each of the left and right flanges 83, 93 of the left and right side plates 8, 9 substantially comes into contact with the rear surface of each of the left and right rear flanges 71, 72 of the front side plate 7. Further, the front end edge of each of the left and right connecting flanges 81, 91 of the left and right side plates 8, 9 is opposed to the rear end edge of the lower portion of the outer peripheral side plate of the decorative cover 4 via the gap G.

According to the present embodiment, the left and right connecting flanges 81, 91 of the left and right side plates 8, 9 of the piping cover 6 that are connected to the casing 1 have the left and right L-shaped notches 85, 95, respectively. Therefore, even if the widths of the left and right connecting flanges 81, 91 in the lateral direction are narrow, the L-shaped notches 85, 95 having the left and right first slits 85*a*, 95*a* of a constant length and the left and right second slits 85*b*, 95*b* of a constant length can be formed in the left and right connecting flanges 81, 91. Further, the left and right L-shaped notches 85, 95 open to the inner ends of the left and right connecting flanges 81, 91, respectively. Further, the left and right L-shaped notches 85, 95 have the left and right first slits 85*a*, 95*a* extending outward from the inner ends of left and right connecting flanges 81, 91, respectively. Further, the left and right L-shaped notches 85, 95 have the left and right second slits 85*b*, 95*b* bent and extending frontward from the outer ends of the left and right first slits 85*a*, 95*a* in the left and right connecting flanges 81, 91, respectively. Therefore, when the piping cover 6 is connected to the casing 1, the screw shaft parts 5*b* of the fixing screws 5 can be easily fitted into the left and right first slits 85*a*, 95*a* from the inner ends of the left and right connecting flanges 81, 91 in a state where the fixing screws 5 are attached to the bottom surface 23 of the casing body 2. Then, according to the present embodiment, when the screw shaft parts 5*b* of the fixing screws 5 inserted into the left and right first slits 85*a*, 95*a* are slid frontward and inserted into the left and right second slits 85*b*, 95*b*, the piping cover 6 can be connected to the casing 1 at a predetermined position. Accordingly, when the piping cover 6 is connected to the casing 1, workability can be improved. Additionally, according to the present embodiment, since the fixing screws 5 are screwed to the final fastening positions to connect the left and right side plates 8, 9 to the bottom surface 23 of the casing body 2, the piping cover 6 can be connected to the casing 1 with higher strength than the conventional elastic support part. As a result, even when an external force is applied to the piping cover 6, the piping cover 6 is not easily displaced from the casing 1.

Further, according to the present embodiment, when the piping cover 6 is connected to the casing 1, the front end edges of the left and right connecting flanges 81, 91 are opposed to the rear end edge of the lower portion of the outer peripheral side plate of the decorative cover 4 forming the front surface of the casing 1 via the gap G. Therefore, when the piping cover 6 is connected to the casing 1, interference between the left and right connecting flanges 81, 91 and the decorative cover 4 can be prevented, and workability can be improved. Further, even if an external force is applied to the piping cover 6 from a rear side, the front end edges of the left and right connecting flanges 81, 91 come into contact with the rear end edge of the lower portion of the outer peripheral side plate of the decorative cover 4 that is the rear end edge of the lower end of the front cover of the casing 1, and frontward movement of the piping cover 6 is restricted. Accordingly, displacement of the piping cover 6 can be curbed.

According to the present embodiment, the front side plate 7, the left side plate 8, and the right side plate 9, which are three independent members, are connected to form the piping cover 6. Accordingly, these side plates 7, 8, 9 can be separately attached to the casing 1. Therefore, the workability can be further improved. Further, when the front side plate 7 is connected to the left and right side plates 8, 9, the front surfaces of the left and right front flanges 83, 93 of the left and right side plates 8, 9 substantially come into contact with the rear surfaces of the left and right rear flanges 71, 72 of the front side plate 7, respectively. Accordingly, even if an external force is applied to the piping cover 6 from the front side, impact can be dispersed by large flanges of the side plates, and displacement and deformation of the piping cover 6 can be curbed.

According to the embodiment described above, all the connecting flanges are formed on the left and right side plates. However, according to the present invention, the connecting flange only needs to be formed on at least one of the side plates connected to the casing, and may be formed on the front side plate, or may be formed on all the side plates. Further, the connecting flange may be detachably connected to the side plate.

As described in detail, the present invention is summarized as follows.

According to the present invention, there is provided a piping cover disposed below a casing accommodating a heat source device and detachably connected to the casing, the piping cover comprising a side plate, wherein the side plate includes a connecting flange extending toward an inside of the piping cover at an upper end thereof, the connecting flange has an L-shaped notch into which a connector protruding downward from a bottom surface of the casing is inserted, and the L-shaped notch includes a first slit opening to an inner end of the connecting flange and extending outward from the inner end of the connecting flange, and a second slit bent and extending from an outer end of the first slit in the connecting flange.

According to the piping cover described above, even if a width of the connecting flange is narrow, the L-shaped notch having the first slit of a constant length and the second slit of a constant length can be formed in the connecting flange. Further, the first slit opens to the inner end of the connecting flange. Therefore, the connector can be easily fitted into the first slit from the inner end of the connecting flange in a state where the connector is attached to the bottom surface of the casing. Then, according to the piping cover described above, when the connector inserted into the first slit is slid and inserted into the second slit, the piping cover can be connected to the casing at a predetermined position. Accordingly, when the piping cover is connected to the casing, workability can be improved.

Preferably, in the piping cover described above, the casing includes a front cover forming a front surface thereof, the piping cover includes a left side plate and a right side plate, the left side plate includes a left connecting flange extending toward the inside of the piping cover at an upper end thereof, the right side plate includes a right connecting flange extending toward the inside of the piping cover at an upper end thereof, the left connecting flange has a left L-shaped notch into which a left connector protruding downward from the bottom surface of the casing is inserted, the left L-shaped notch includes a left first slit opening to an inner end of the left connecting flange and extending outward from the inner end of the left connecting flange, and a left second slit bent and extending from an outer end of the left first slit in the left connecting flange, the right connecting flange has a right L-shaped notch into which a right connector protruding downward from the bottom surface of the casing is inserted, the right L-shaped notch includes a right first slit opening to an inner end of the right connecting flange and extending outward from the inner end of the right connecting flange, and a right second slit bent and extending from an outer end of the right first slit in the right connecting flange, and each of the left and right connecting flanges is formed such that when the piping cover is connected to the casing, a front end edge of each of the left and right connecting flanges faces a rear end edge of a lower end of the front cover of the casing with a gap of a certain size interposed therebetween.

According to the piping cover described above, the front end edges of the left and right connecting flanges are opposed to the rear end edge of the lower end of the front cover forming the front surface of the casing with the gap G of the certain size interposed therebetween. Therefore, when the piping cover is connected to the casing, interference between the left and right connecting flanges and the front cover can be prevented, and workability can be improved. Further, according to the piping cover described above, even if an external force is applied to the piping cover from a rear side, the front end edges of the left and right connecting flanges come into contact with the rear end edge of the lower end of the front cover of the casing, and frontward movement of the piping cover is restricted. Accordingly, displacement of the piping cover can be curbed.

Preferably, in the piping cover described above, the piping cover includes a front side plate, the left side plate, and the right side plate, the front side plate, the left side plate, and the right side plate are connected to each other in a detachable manner, the front side plate includes a left rear flange extending toward the inside of the piping cover at a left end thereof and a right rear flange extending toward the inside of the piping cover at a right end thereof, the left side plate includes the left connecting flange and a left front flange extending toward the inside of the piping cover at a front end thereof, the right side plate includes the right connecting flange and a right front flange extending toward the inside of the piping cover at a front end thereof, and the piping cover is provided such that when the front side plate and the left and right side plates are connected to each other, a front surface of the left front flange of the left side plate substantially comes into contact with a rear surface of the left rear flange of the front side plate and a front surface of the right front flange of the right side plate substantially comes into contact with a rear surface of the right rear flange of the front side plate.

According to the piping cover described above, the front side plate, the left side plate, and the right side plate, which are independent members, are connected to form the piping cover. Accordingly, these side plates can be separately attached to the casing. Therefore, the workability can be further improved. Further, according to the piping cover described above, when the front side plate is connected to the left and right side plates, the front surfaces of the left and right front flanges of the left and right side plates substantially come into contact with the rear surfaces of the left and right rear flanges of the front side plate, respectively. Accordingly, even if an external force is applied to the piping cover from a front side, impact can be dispersed by large flanges of the side plates, and displacement and deformation of the piping cover can be curbed.

The present application claims a priority based on a Japanese Patent Application No. 2021-88411 filed on May 26, 2021, the content of which is hereby incorporated by reference in its entirely.

Although the present invention has been described in detail, the foregoing descriptions are merely exemplary at all aspects, and do not limit the present invention thereto. It should be understood that an enormous number of unillustrated modifications may be assumed without departing from the scope of the present invention.

The invention claimed is:

1. A connection structure comprising:

a casing accommodating a heat source device; and a piping cover disposed below the casing and detachably connected to the casing, wherein the casing includes a front cover forming a front surface thereof, the piping cover includes a left side plate and a right side plate, the left side plate includes a left connecting flange extending toward an inside of the piping cover at an upper end thereof, the right side plate includes a right connecting flange extending toward the inside of the piping cover at an upper end thereof, the left connecting flange has a left L-shaped notch into which a left connector protruding downward from a bottom surface of the casing is inserted, the left L-shaped notch includes a left first slit which opens at an inner edge of the left connecting flange and extends outward from the inner edge of the left connecting flange to an outer end of the left first slit, and a left second slit which extends from the outer end of the left first slit such that the left second slit is bent at an angle relative to the left first slit, the right connecting flange has a right L-shaped notch into which a right connector protruding downward from the bottom surface of the casing is inserted, the right L-shaped notch includes a right first slit which opens at an inner edge of the right connecting flange and extends outward from the inner edge of the right connecting flange to an outer end of the right first slit, and a right second slit which extends from the outer end of the right first slit such that the right second slit is bent at an angle relative to the right first slit, and each of the left and right connecting flanges is formed such that when the piping cover is connected to the casing, a front end edge of each of the left and right connecting flanges faces a rear end edge of a lower end of the front cover of the casing with a gap of a predetermined size interposed therebetween.

2. The connection structure according to claim 1, wherein the piping cover includes a front side plate, the left side plate, and the right side plate, the front side plate, the left side plate, and the right side plate are connected to each other in a detachable manner, the front side plate includes a left rear flange extending toward the inside of the piping cover at a left end thereof and a right rear flange extending toward the inside of the piping cover at a right end thereof, the left side plate includes a left front flange extending toward the inside of the piping cover at a front end thereof, the right side plate includes a right front flange extending toward the inside of the piping cover at a front end thereof, and the piping cover is provided such that when the front side plate and the left and right side plates are connected to each other, a front surface of the left front flange of the left side plate substantially comes into contact with a rear surface of the left rear flange of the front side plate and a front surface of the right front flange of the right side plate substantially comes into contact with a rear surface of the right rear flange of the front side plate.

* * * * *